US009358560B2

(12) United States Patent
Kosaka et al.

(10) Patent No.: US 9,358,560 B2
(45) **Date of Patent: *Jun. 7, 2016**

(54) SPRAY GUN

(71) Applicant: ANEST IWATA CORPORATION, Yokohama-shi, Kanagawa (JP)

(72) Inventors: Shozo Kosaka, Yokohama (JP); Masaru Kaneko, Fujisawa (JP); Nobuyoshi Morita, Yokohama (JP); Takayuki Hata, Yokohama (JP); Atsushi Morohoshi, Yokohama (JP); Nobuhiro Sawata, Yokohama (JP)

(73) Assignee: ANEST IWATA CORPORATION, Yokohama-shi (JP)

( * ) Notice: Subject to any disclaimer, the term of this patent is extended or adjusted under 35 U.S.C. 154(b) by 256 days.

This patent is subject to a terminal disclaimer.

(21) Appl. No.: 13/687,684

(22) Filed: Nov. 28, 2012

(65) Prior Publication Data

US 2014/0042248 A1 Feb. 13, 2014

(30) Foreign Application Priority Data

Aug. 10, 2012 (JP) ..... 2012-177985

(51) Int. Cl.
*B05B 7/06* (2006.01)
*B05B 7/08* (2006.01)

(52) U.S. Cl.
CPC ..... *B05B 7/066* (2013.01); *B05B 7/0815* (2013.01)

(58) Field of Classification Search
CPC ..... B05B 7/0815; B05B 7/0861; B05B 7/06; B05B 7/062; B05B 7/066; B05B 7/12
USPC ..... 239/292, 296–301, 407, 408, 413–415, 239/416, 416.4–417.5, 418, 420, 239/423–424.5, 526
See application file for complete search history.

(56) References Cited

U.S. PATENT DOCUMENTS 1,751,787 A * 3/1930 Binks ..... 239/299
2,646,314 A 7/1953 Peeps
3,583,632 A 6/1971 Shaffer et al.

(Continued)

FOREIGN PATENT DOCUMENTS

EP 0 092 392 A2 10/1983
EP 0 650 766 B1 4/1999

(Continued)

OTHER PUBLICATIONS

Extended European Search Report issued in European Patent Application No. 13179877.9 dated Oct. 31, 2013.

(Continued)

*Primary Examiner* — Christopher Kim
(74) *Attorney, Agent, or Firm* — Oliff PLC

(57) ABSTRACT

A spray gun including: a body having a gun barrel, a coating material nozzle disposed on a tip end side of the gun barrel; and an air cap disposed on the tip end side of the gun barrel to surround a tip end portion of the coating material nozzle, wherein the tip end portion of the coating material nozzle has on the tip end surface thereof a guide wall spreading and also has on the outer peripheral surface thereof a plurality of air grooves in a V shape channeled in a longitudinal direction, and wherein each of the air grooves has a bottom portion gradually increasing in depth in the longitudinal direction, the bottom portion having a curvature radius of 0.15 mm or less.

7 Claims, 7 Drawing Sheets

(56) References Cited

U.S. PATENT DOCUMENTS

| | | | | |
|---|---|---|---|---|
| 3,746,253 | A | 7/1973 | Walberg | |
| 3,747,850 | A | 7/1973 | Hastings et al. | |
| 3,857,511 | A | 12/1974 | Govindan | |
| 3,873,023 | A | 3/1975 | Moss et al. | |
| 4,273,293 | A | 6/1981 | Hastings | |
| 4,884,742 | A | 12/1989 | Bekius et al. | |
| 5,064,119 | A | 11/1991 | Mellette | |
| 5,078,323 | A | 1/1992 | Frank | |
| 5,080,285 | A | 1/1992 | Toth | |
| 5,088,648 | A | 2/1992 | Schmon | |
| 5,090,623 | A | 2/1992 | Burns et al. | |
| 5,249,746 | A | 10/1993 | Kaneko et al. | |
| 5,344,078 | A | 9/1994 | Fritz et al. | |
| 5,435,491 | A | 7/1995 | Sakuma | |
| 5,456,414 | A | 10/1995 | Burns et al. | |
| 5,540,385 | A | 7/1996 | Garlick | |
| 5,607,108 | A | 3/1997 | Garlick et al. | |
| 5,613,637 | A | 3/1997 | Schmon | |
| 5,941,461 | A | 8/1999 | Akin et al. | |
| 5,992,763 | A | 11/1999 | Smith et al. | |
| 6,494,387 | B1 * | 12/2002 | Kaneko | 239/296 |
| 6,708,900 | B1 | 3/2004 | Zhu et al. | |
| 7,163,160 | B2 | 1/2007 | Liu | |
| 8,225,892 | B2 | 7/2012 | Ben-Tzvi | |
| 2005/0145718 | A1 | 7/2005 | Blette et al. | |

FOREIGN PATENT DOCUMENTS

| | | | |
|---|---|---|---|
| EP | 1 108 476 | A1 | 6/2001 |
| JP | S58-119862 | U | 8/1983 |
| JP | S 6155951 | U | 4/1986 |
| JP | H 0177863 | U | 5/1989 |
| JP | H06-304501 | A | 11/1994 |
| JP | A-08-196950 | | 8/1996 |
| JP | 2002-001169 | A | 1/2002 |
| JP | 2010-502419 | A | 1/2010 |
| JP | 2014-033993 | A | 2/2014 |
| WO | WO 01/02099 | | 1/2001 |
| WO | 2008/029229 | A1 | 3/2008 |

OTHER PUBLICATIONS

Rone, William S. et al. "MEMS-Based Microdroplet Generation with Integrated Sensing". Excerpt from the Proceedings of the 2011 COMSOL Conference in Boston, Exhibit 2018 in IPR2013-00111.
Oct. 11, 2013 Larimer Deposition, Exhibit 2021 in IPR2013-00111.
Oct. 14, 2013 Schmon Deposition, Exhibit 2022 in IPR2013-00111.
Oct. 15, 2013 BenTzvi Deposition, Exhibit 2023 in IPR2013-00111.
Oct. 17, 2013 Akafuah Deposition, Exhibit 2024 in IPR2013-00111.
Oct.-Dec. 1996 SATA News Publication Dan-Am, Exhibit 1035 in IPR2013-00111.
Dec. 9, 2013 Demonstrative 1, Substitute Claim 23, Exhibit 2025 from IPR2013-00111.
Dec. 9, 2013 Demonstrative 2, From pp. 44-46 of the transcript of the deposition of Nelson Akafuah, Exhibit 2026 in IPR2013-00111.
Jan. 6, 2015 Office Action issued in Japanese Patent Application No. 2012-173256.
Dec. 2, 2014 Office Action issued in Japanese Patent Application No. 2012-177985.
Dec. 2, 2014 Office Action issued in Japanese Patent Application. 2012-192467.
Dec. 2, 2014 Office Action issued in Japanese Patent Application No. 2012-176150.
Jan. 6, 2015 Office Action issued in Japanese Patent Application No. 2012-192468.
Nov. 18, 2013 Extended European Search Report issued in European Patent Application No. 13179078.4.
Dec. 10, 2013 Extended European Search Report issued in European Patent Application No. 13182003.7.
Jan. 11, 2013 Petition for Inter Partes Review in IPR2013-00111.
Apr. 10, 2013 Preliminary Response in IPR2013-00111.
May 23, 2013 Decision in IPR2013-00111.
Jun. 6, 2013 Petitioner's Request for Rehearing in IPR2013-00111.
Jun. 25, 2013 Decision on Rehearing in IPR2013-00111.
Jul. 25, 2013 Motion to Amend in IPR2013-00111.
Aug. 8, 2013 Motion to Amend (updated) in IPR2013-00111.
Sep. 30, 2013 Petitioner's Opposition in IPR2013-00111.
Oct. 21, 2013 Reply in IPR2013-00111.
Nov. 11, 2013 Motion to Exclude Evidence in IPR2013-00111.
Nov. 25, 2013 Petitioner's Opposition in IPR2013-00111.
Dec. 2, 2013 Reply to Petitioner's Opposition in IPR2013-00111.
Apr. 9, 2014 Oral Hearing Transcript in IPR2013-00111.
May 20, 2014 Final Written Decision in IPR2013-00111.
Jan. 24, 2013 First drawing based on Fig.2 of JP 8-196950, Exhibit 1003 in IPR2013-00111.
Jan. 24, 2013 Second drawing based on Fig. 2 of JP 8-196950, Exhibit 1004 in IPR2013-00111.
Jan. 24, 2013 Third drawing based on Fig 2 of JP 8-196950, Exhibit 1005 in IPR2013-00111.
Printout from Internet http://www.ehow.com/how_4493101_choose-spray-gun-auto-paint.html obtained Sep. 7, 2012, Exhibit 1023 in IPR2013-00111.
Printout from Internet http://www.bodyshopbusiness.com/Article/3512/common_sense_spraygun_tips.aspx obtained Sep. 7, 2012, Exhibit 1024 in IPR2013-00111.
Printout from Internet Brochure of Walther Pilot, www.walther-pilot.de published Mar. 2007, Exhibit 1025 in IPR2013-00111.
Printout from Internet http://www.alsacorp.com/products/hvlp-sprayguns/ obtained Aug. 26, 2012, Exhibit 1026 in IPR2013-00111.
Printout from Internet p. 28 from current 3M brochure, http://homesteadfinishingproducts.com/wp-content/uploads/2014/04/34/8701-7283-9-Automatic-Gun-Manual.pdf (2008), Exhibit 1027 in IPR2013-00111.
Sep. 5, 2012 Declaration of Knud Jorgensen, Exhibit 1028 in IPR2013-00111.
Apr. 12, 2012 decision by EPO, Exhibit 1029 in IPR2013-00111.
May 5, 2005 claims in issue in the Opp Proceeding of Exhibit 1029, Exhibit 1030 in IPR2013-00111.
Jan. 24, 2013 Prior art statement showing state-of-the-art in mid 1990s, Exhibit 1031 in IPR2013-00111.
Jul.-Sep. 1996 SATA News Publication Dan-Am, Exhibit 1034 in IPR2013-00111.
Apr.-Jun. 1998 SATA News Publication Dan-Am, Exhibit 1036 in IPR2013-00111.
1991 Dan-Am SATA Catalog 6 for spray guns, Exhibit 1037 in IPR2013-00111.
1994 Dan-Am SATA Catalog 8 for spray guns, Exhibit 1038 in IPR2013-00111.
1991 Dan-Am Catalog pp. 6-51, Exhibit 1042 in IPR2013-00111.
Mar. 1, 1991 JIS B 9809 English translation, Exhibit 1049 in IPR2013-00111.
Mar. 1, 1991 JIS B 9809, Exhibit 1050 in IPR2013-00111.
SATA LM 92 blueprints, SATA Gmbh (1984, 1986, 1990, 1992), Exhibit 1055 in IPR2013-00111.
SATAjet K, SATA Gmbh (1987, 1991, 1992), Exhibit 1056 in IPR2013-00111.
SATA NR 95, SATA Gmbh (1994, 1996), Exhibit 1057 in IPR2013-00111.
SATAjet 90, SATA Gmbh (1989, 1994, 1995, 1996, 1997), Exhibit 1058 in IPR2013-00111.
SATA GRZ, SATA Gmbh (1987, 1992), Exhibit 1059 in IPR2013-00111.
SATAjet B, SATA Gmbh (1980, 1987, 1991, 1992), Exhibit 1060 in IPR2013-00111.
SATAjet H, SATA Gmbh (1983, 1987, 1991), Exhibit 1061 in IPR2013-00111.
Enlarged view of table on p. 4 of SATAjet H (NPL 41), SATA Gmbh (1987), Exhibit 1062 in IPR2013-00111.
Jan. 1, 1995 SATA Gmbh Price list, Exhibit 1063 in IPR2013-00111.
Twist nozzle set with translation and certificate (1973, 1976), Exhibit 1064 in IPR2013-00111.
Sep. 18, 2013 Declaration of Nelson K Akafuah, Exhibit 1065 in IPR2013-00111.
Sep. 20, 2013 Declaration of Pinhas Ben-Tzvi, Exhibit 1066 in IPR2013-00111.

(56) References Cited

OTHER PUBLICATIONS

Sep. 23, 2013 Declaration of Anthony Larimer, Exhibit 1067 in IPR2013-00111.
Sep. 24, 2013 Declaration of Dr. Schmon signed, Exhibit 1068 in IPR2013-00111.
Sep. 13, 2013 Excerpted pages from EX2009 Lacovara Transcript, Exhibit 1069 in IPR2013-00111.
"How to Prepare Drawings for Patent Applications in Japan", http://www.jpo.go.jp/toiawase/faq/yokuar10.htm obtained Apr. 9, 2013, Exhibit 2001 in IPR2013-00111.
Jul. 24, 2013 Declaration of Robert R. Lacovara Exhibit 2002 in IPR2013-00111.
Sep. 25, 2013 Proposed Amendment in IPR2013-0011.
Dec. 18, 2013 Fig. 2 of EX1020 p. 13 marked up by witness Lacovara, Exhibit 2008 in IPR2013-00111.
Sep. 13, 2013 Lacovara Deposition, Exhibit 2:009 in IPR2013-00111.
Jan.-Mar. 2009 SATA News, Exhibit 2010 in IPR2013-00111.
SATA Dan-Am Air with Tony Larimer—YouTube, http://www.youtube.com/watch?v=iJtAGIAmSB0 obtained Oct. 9, 2013, Exhibit 2011 in IPR2013-00111.
Sata Spray Guns and Airbrush, http://www.myrideisme.com/Blog/sata-auto-paint-guns-sema/ obtained Oct. 9, 2013, Exhibit 2012 in IPR2013-00111.
How to Set Air Pressure Air Volume—YouTube, http://www.youtube.com/watch?v=HDuuJvyiZi1 obtained Oct. 9, 2013, Exhibit 2013 in IPR2013-00111.
Ohio EPA Letter to Tony Larimer submitted Nov. 11, 2013, Exhibit 2014 in IPR2013-00111.
Ben-Tzvi, Pinhas et al. "A Conceptual Design and FE Analysis of a Piezoceramic Actuated Dispensing System for Microdrops Generation in Microarray Applications". ScienceDirect (2007), Exhibit 2015 in IPR2013-00111.
Printout from Internet, http://www.amazon.com/DISPENSING-MICRODROPS-GENERATION-MEDICAL-A . . . obtained Oct. 14, 2013, Exhibit 2017 in IPR2013-00111.
Mar. 24, 2016 Office Action Issued in U.S. Appl. No. 13/687,608.

* cited by examiner

SPRAY GUN

TECHNICAL FIELD

The present invention relates to a spray gun, in particular, a spray gun for mixing and atomizing a coating material flow and an air flow in the atmosphere.

BACKGROUND ART

For example, Japanese Unexamined Patent Application Publication No. 8-196950 (Patent Literature 1) and WO01/02099 (Patent Literature 2) disclose a spray gun, in which a gun barrel of the spray gun is provided with a coating material nozzle that ejects a coating material flow from a coating material ejection opening of a tip end portion thereof, and a air cap that surrounds the tip end portion of the coating material nozzle and defines in a gap with the tip end portion a ring shaped slit that ejects an air flow.

The tip end portion of the coating material nozzle is formed with a guide wall on a tip end surface thereof spreading from an opening edge of the coating material ejection opening toward a tip end side, and a plurality of V shaped air grooves on an outer peripheral surface thereof channeled from a predetermined position on a rear end side to the guide wall in a longitudinal direction. The guide wall is adapted to restrict the coating material flow ejected from the coating material ejection opening. The air grooves are adapted to guide a part of the air flow toward a front of the coating material ejection opening.

In the spray gun thus configured, when coating material is ejected from the coating material ejection opening to form the coating material flow, the air flow is introduced to the air grooves through the slit from a gun body to collide and mix with the coating material flow ejected from the coating material ejection opening while increasing in gas-liquid contact area. As a result thereof, it is possible, even if a low pressure air flow is employed, to effectively atomize the ejected coating material up to a central portion thereof.

SUMMARY OF INVENTION

Technical Problem

In order to form the air guide groove of the tip end portion of the coating material nozzle, a cutting tool is generally employed. Here, unless the cutting tool is in mint condition, a cutting edge thereof rarely has a cross section in a shape of intersection of two sides, but generally forms what is called "nose R".

As a result thereof, a bottom portion of the air guide groove, which is formed by the cutting tool, rarely has a cross section in a shape of intersection of two sides, but generally has a curvature radius R. Furthermore, a continual use of the cutting tool in machining will wear the cutting edge thereof, thereby the curvature radius R of the bottom portion of the air guide groove will inevitably enlarge.

If the curvature radius R of the bottom portion of the air guide groove enlarges, a triangle shaped area (defined as a "passage area" in the present specification) partitioned by an intersection contour of the air guide groove with the guide wall becomes small, a length corresponding to a height of the triangle shaped area becomes short, and a collision time of the air flow and the coating material flow becomes short, thereby encountering a drawback in which mixture efficiency of the air flow with the coating material flow decreases.

However, in this case, since the air flow mixes with the coating material flow instantaneously, and the coating material diffuses instantaneously, another drawback is encountered in which the coating material flow from the coating material nozzle adheres to the air cap disposed in proximity to the coating material nozzle.

The present invention has been made in view of above described circumstances, and an object thereof is to improve mixture efficiency of the air flow with the coating material flow and to provide a spray gun that can avoid adherence of the coating material flow from the coating material nozzle to the air cap.

Solution to Problem

In order to attain the above-described drawback, in accordance with the first aspect of the present invention, there is provided a spray gun for mixing and atomizing a coating material flow and the air flow in the atmosphere, the spray gun including: a body having a gun barrel, a coating material nozzle disposed on a tip end side of the gun barrel, ejecting the coating material flow from a coating material ejection opening formed on a tip end surface thereof; and an air cap disposed on the tip end side of the gun barrel to surround a tip end portion of the coating material nozzle, the air cap defining a ring-shaped slit between an inner peripheral surface thereof and an outer peripheral surface of the tip end portion of the coating material nozzle to allow the air flow to be ejected therethrough, wherein the tip end portion of the coating material nozzle has on the tip end surface thereof a guide wall spreading from an internal periphery of the coating material ejection opening toward a tip end side of the coating material nozzle, the guide wall controlling the coating material flow ejected from the coating material ejection opening, and also has on the outer peripheral surface thereof a plurality of air grooves in a V shape channeled in a longitudinal direction from a rear end side thereof in a predetermined position to the guide wall, the air grooves inducing a part of the air flow ahead of the coating material ejection opening, wherein each of the air grooves has a bottom portion gradually increasing in depth in the longitudinal direction, the bottom portion having a curvature radius R of 0.15 mm or less.

In accordance with a second aspect of the present invention, according to the first aspect of the spray gun, the guide wall may be in a conical shape and have an outer peripheral edge located inwardly from an outer periphery of the tip end portion of the coating material nozzle in the range not exceeding 0.5 mm in front view.

In accordance with a third aspect of the present invention, according to the first aspect of the spray gun, the guide wall may be in a conical shape having an opening angle in the range of 60 degrees to 150 degrees in side view.

In accordance with a fourth aspect of the present invention, according to the first aspect of the spray gun, the air groove may be formed with the bottom portion having a convergence angle directing toward the tip end side of the coating material nozzle in the range of 30 degrees to 100 degrees.

In accordance with a fifth aspect of the present invention, according to the first aspect of the spray gun, the air groove may have a length in the longitudinal direction of the coating material nozzle from the rear end side thereof in the predetermined position to the foremost of the tip end surface of the coating material nozzle in the range of 1 mm to 3.5 mm.

In accordance with a sixth aspect of the present invention, according to the first aspect of the spray gun, the air groove may have an opening angle of the V-shaped cross section in the range of 20 degrees to 100 degrees.

In accordance with a seventh aspect of the present invention, according to the first aspect of the spray gun, the bottom portion of the air groove may be located on the guide wall of the coating material nozzle between at 0.5 mm ahead and at 0.5 mm behind, in relation to a front surface of the air cap proximate to the coating material nozzle, in the longitudinal direction of the tip end portion of the coating material nozzle.

Advantageous Effects of Invention

In the aforementioned spray gun, According to the spray gun thus configured, it becomes possible to improve mixture efficiency of the air flow with the coating material flow and to avoid adherence of the coating material flow from the coating material nozzle to the air cap.

BRIEF DESCRIPTION OF THE DRAWINGS

FIG. 6 is a side view and a front view showing, together with the coating material nozzle, an auxiliary air hole formed on the air cap of the spray gun according to the first embodiment of the present invention.

FIG. 7 is a diagram illustrating a distribution of ejection amount of coating material in accordance with opening angle of a guide wall on a tip end surface of the spray gun according to the first embodiment of the present invention.

FIG. 8 is a configuration diagram showing a principal part of a spray gun according to a second embodiment of the present invention.

DESCRIPTION OF EMBODIMENTS

Figure 1:
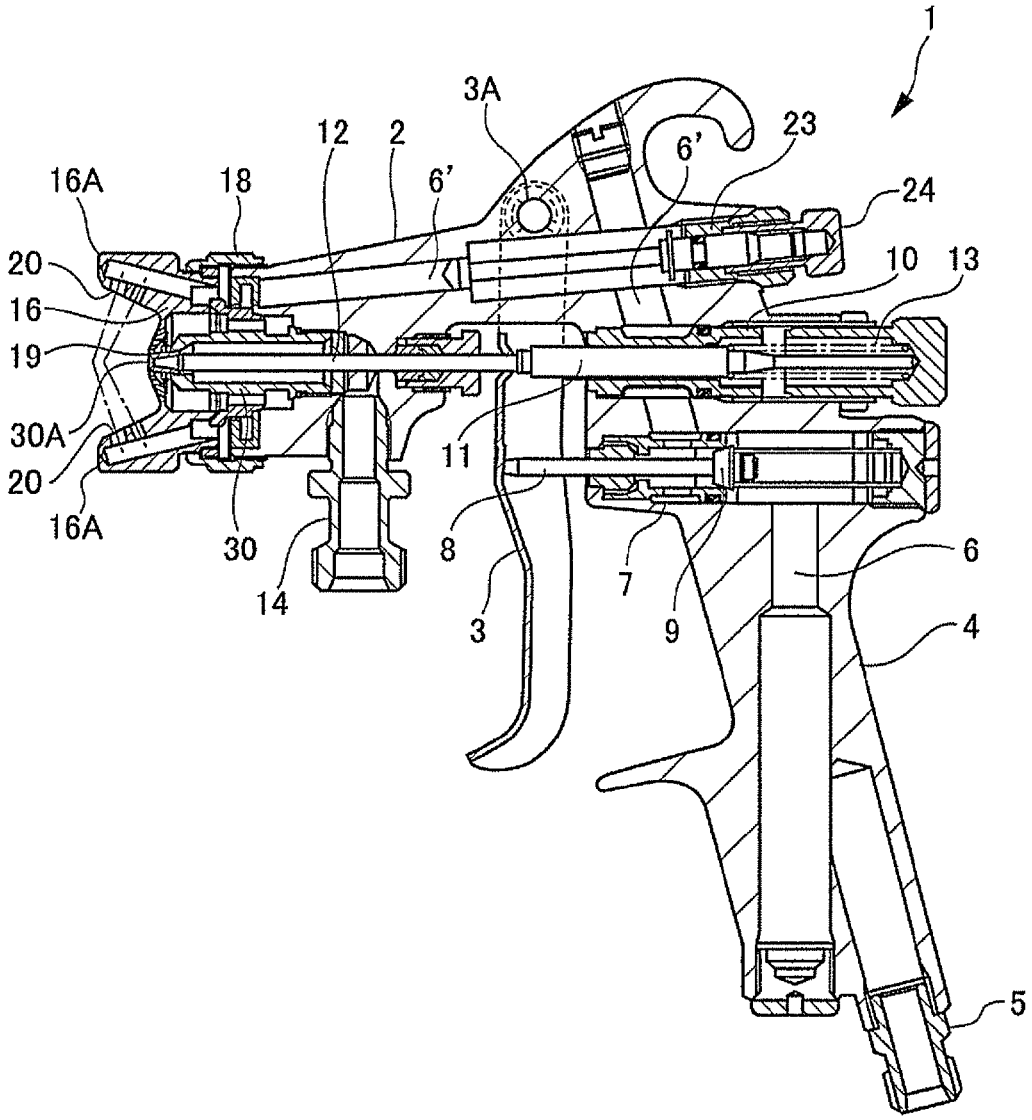
FIG. 1 is an overall configuration diagram of a spray gun according to a first embodiment of the present invention.

In the following, a detailed description will be given of embodiments of the present invention with reference to drawings. In all embodiments of the present specification, the same constituent elements have the same reference numerals.

First Embodiment

FIG. 1 is an overall configuration diagram of a spray gun 1 according to a first embodiment of the present invention;

In FIG. 1, the spray gun (body) 1 is configured to include a gun barrel (gun barrel) 2, a trigger 3, and a grip part 4. In the spray gun 1 shown in FIG. 1, a coating material flow and an air flow are ejected from a tip end portion of the gun barrel 2 in accordance with an operation of the trigger 3 to be mixed and atomized in the atmosphere.

In the description of constituent elements shown in FIG. 1, it should be noted that a side of the gun barrel 2 may be referred to as a "tip end" or a "front side", and an opposite side to the gun barrel 2 may be referred to as a "rear end" or a "rear side".

In FIG. 1, a compressed air is transmitted from the grip part 4 of the spray gun 1 to an air valve part 7 via an air nipple 5 and an air passage 6, and then to the tip end portion of the gun barrel 2 via an air passage 6'. The trigger 3 is adapted to be pulled toward a side of the grip part 4 centering on a fulcrum 3A, thereby to open an air valve 9 of the air valve part 7 via a valve stem 8 so that the compressed air is transmitted to the tip end portion of the gun barrel 2. To the trigger 3, there is fixed a needle valve guide 11 that recedes in a guide chamber 10 by pulling the trigger 3. To the needle valve guide 11, there is fixed a needle valve 12 disposed along a central axis of the gun barrel 2. When the trigger 3 is not pulled, a coil spring 13 disposed in the guide chamber 10 is adapted to press the needle valve 12 to an inner surface of a seat of a coating material ejection opening 30A of a coating material nozzle 30, which is mounted to a tip end side of the gun barrel 2, so that the seat of the coating material ejection opening 30A is sealed.

When the trigger 3 is pulled, the air valve 9 is configured to be open slightly sooner than the needle valve 12 is pulled away from the coating material ejection opening 30A of the coating material nozzle 30.

The coating material nozzle 30 is configured by a cylindrical member whose tip end portion (hereinafter, referred to as a "nozzle tip end portion 31") is small in diameter and whose rear end portion is large in diameter. The rear end portion of the coating material nozzle 30 is formed with a coating material joint 14. Coating material is supplied to the coating material nozzle 30 from, for example, a coating material reservoir (not shown) or the like that is attached to the coating material joint 14. When the needle valve 12 of the coating material nozzle 30 is open, the coating material supplied to the coating material nozzle 30 is ejected as the coating material flow from the coating material ejection opening 30A of the coating material nozzle 30.

An air cap 16 is disposed so as to surround the nozzle tip end portion 31 of the coating material nozzle 30. The air cap 16 is attached to the gun barrel 2 by means of an air cap cover 18. A slit 19 in a ring shape is formed between an inner peripheral surface of the air cap 16 and an outer peripheral surface of the nozzle tip end portion 31 of the coating material nozzle 30. The slit 19 is adapted so that the compressed air from the air passage 6' may form the air flow ejected through the slit 19 along the outer peripheral surface of the nozzle tip end portion 31 of the coating material nozzle 30.

Figure 2:
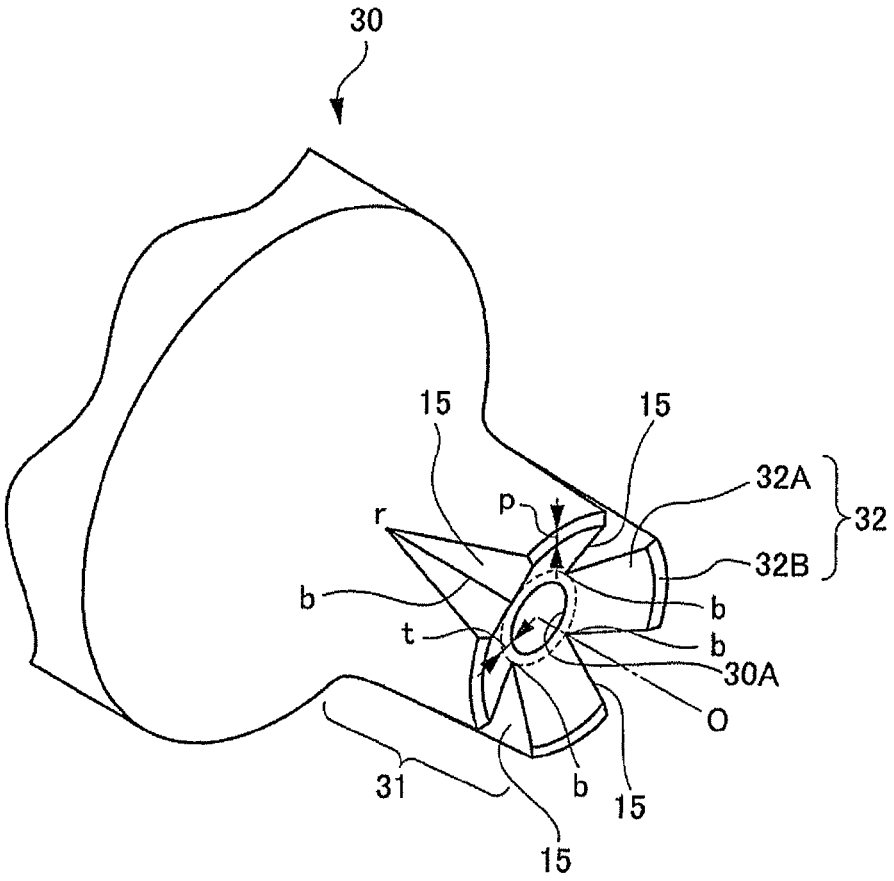
FIG. 2 is a perspective view showing a tip end portion of a coating material nozzle of the spray gun according to the first embodiment of the present invention.

As shown in FIG. 2, the nozzle tip end portion 31 of the coating material nozzle 30 includes a tip end surface 32. The coating material ejection opening 30A is formed on a central axis of the tip end surface 32. An inner diameter of the coating material ejection opening 30A is formed relatively small compared to an outer diameter of the nozzle tip end portion 31 of the coating material nozzle 30. The tip end surface 32 of the coating material nozzle 30 includes a guide wall 32A that controls the coating material flow ejecting from the coating material ejection opening 30A. The guide wall 32A is formed in a conical shape spreading from an internal periphery of the coating material ejection opening 30A toward a tip end side of the coating material nozzle 30. The guide wall 32A is configured to have an outer peripheral edge within a radial distance p of 0.5 mm or less from an outer peripheral edge of the nozzle tip end portion 31 of the coating material nozzle 30. This means that the tip end surface 32 of the coating material nozzle 30 is formed with, as well as the guide wall 32A, a flat portion 32B in shape of a ring of 0.5 mm or less in width, which is a surface perpendicular to a central axis O of the coating material nozzle 30 from the outer peripheral edge of the guide wall 32A to the outer peripheral edge of the nozzle tip end portion 31 of the coating material nozzle 30. According to the above described configuration to have the outer peripheral edge of the guide wall 32A within the radial distance p not exceeding 0.5 mm from the outer peripheral edge of the nozzle tip end portion 31 of the coating material nozzle 30, it becomes possible to have an effect of increase in ejection amount of the coating material from the coating material ejection opening 30A and improvement in atomization, which will be described later in detail.

Figure 3:
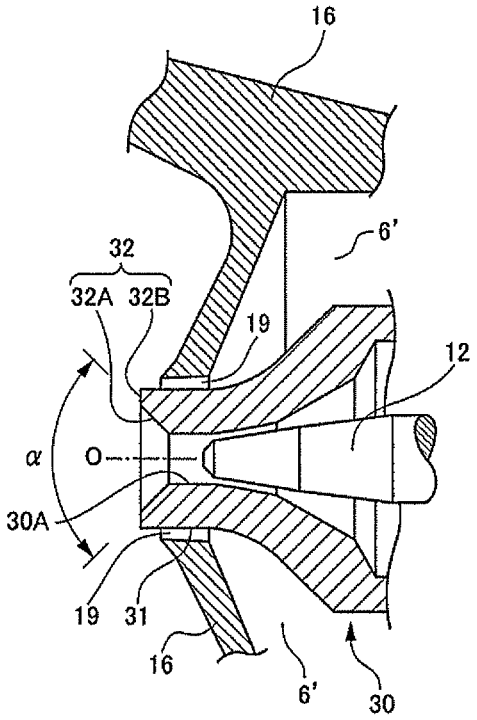
FIG. 3 is a cross sectional view (along a plane not including an air groove) showing, together with an air cap, the tip end portion of the coating material nozzle of the spray gun according to the first embodiment of the present invention.

As shown in FIG. 3, which is an enlarged cross sectional view of the nozzle tip end portion 31 of the coating material nozzle 30, the guide wall 32A in a conical shape is configured to have an opening angle $\alpha$ between 60 and 150 degrees in side view. According to the above described configuration to have the opening angle $\alpha$ of the guide wall 32A between 60 and 150 degrees, it becomes possible to reduce a change in surface angle to the guide wall 32A from a straight passage of the coating material ejection opening 30A of the coating material nozzle 30 and to smooth the coating material flow along the guide wall 32A, as will be described later in detail. Incidentally, as well as the coating material nozzle 30, the needle vale 12 and the air cap 16 are also shown in FIG. 3.

Figure 4:
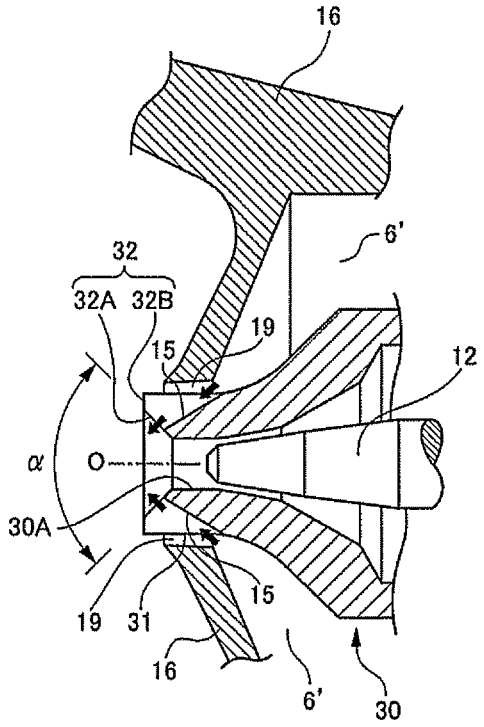
FIG. 4 is a cross sectional view (along a plane including the air groove) showing, together with the air cap, the tip end portion of the coating material nozzle of the spray gun according to the first embodiment of the present invention.

Referring back to FIG. 2, the nozzle tip end portion 31 of the coating material nozzle 30 is formed with, for example, four air grooves 15 at equal spaces in a circumferential direction on the outer peripheral surface thereof. Each air groove 15 has a cross section, for example, in a V shape. Each air groove 15 is channeled from a predetermined position (which may be hereinafter referred to as a "starting point r of the air groove 15") on a rear end side (left side in FIG. 2) up to the tip end surface 32 in a longitudinal direction. Each air groove 15 includes a bottom portion increasing in depth toward the tip end surface 32 of the coating material nozzle 30. The air grooves 15 are configured to guide a part of the air flow ejected through the slit 19 from the air passage 6' toward a front side of the coating material ejection opening 30A. In FIG. 4, which is different from FIG. 3 in that FIG. 4 has a cross section of a part where the air groove 15 is formed, the compressed air from the air passage 6', when being ejected through the slit 19, is introduced in the air grooves 15 of the coating material nozzle 30 as shown by arrows in FIG. 4. The air flow in the air grooves 15 collides and mixes with the coating material flow from the coating material ejection opening 30A of the coating material nozzle 30 increasing gas-liquid contact area. As a result thereof, it becomes possible for the compressed air, even if being a low pressure air flow, to function to atomize up to a central portion of the ejected coating material.

As shown in FIG. 2, each air groove 15 is configured to have the bottom portion (denoted by b in FIG. 2) positioned within a range of the guide wall 32A on the tip end surface 32 of the coating material nozzle 30. More particularly, the bottom portion b of each air groove 15 is formed, on the tip end surface 32 of the coating material nozzle 30, on a circle larger in radius by, for example, t (>0) than an inner circumference of the coating material ejection opening 30A. This means that it is configured so as to exclude a case in which the bottom portion b of each air groove 15 is positioned on the internal periphery of the coating material ejection opening 30A or even penetrates to an inner peripheral surface thereof. According to such configuration that the bottom portion b of each air groove 15 is positioned within the range of the guide wall 32A on the tip end surface of the coating material nozzle 30, it becomes possible to greatly reduce a resistance against the coating material flow generated by the compressed air flowing in the air grooves 15 and penetrating in the coating material flow ejected from the coating material ejection opening 30A of the coating material nozzle 30.

Figure 5:
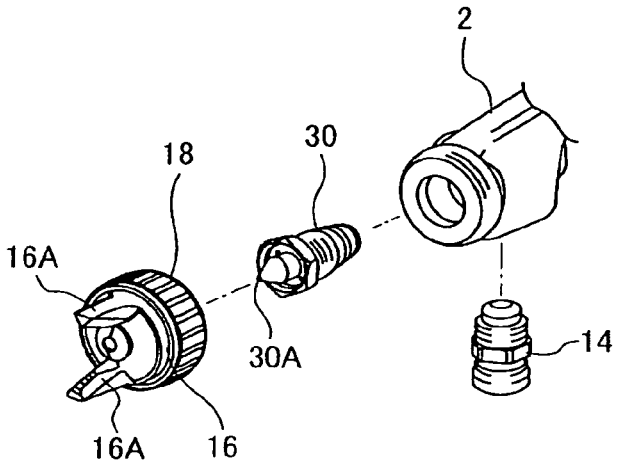
FIG. 5 is an exploded perspective view showing the coating material nozzle, the air cap, and a coating material joint that are mounted to a gun barrel of the spray gun according to the first embodiment of the present invention.

Referring back to FIG. 1, the air cap 16 is formed on a tip end surface thereof with a pair of horn portions 16A having the coating material nozzle 30 in between. FIG. 5 is a perspective view showing the air cap 16 together with a part of the gun barrel 2 in vicinity, which shows that the pair of horn portions 16A are formed so as to face toward each other and have the coating material ejection opening 30A of the coating material nozzle 30 in between. As shown in FIG. 1, each horn portion 16A of the air cap 16 has a side air hole 20 in communication with the air passage 6'. The side air holes 20 are adapted to eject the air flow so as to intersect with the coating material flow from the coating material ejection opening 30A of the coating material nozzle 30. As a result thereof, the coating material ejected from the coating material nozzle 30 can form an elliptical spray pattern by the aid of the compressed air ejected from the side air holes 20 of the air cap 16. The compressed air transmitted to the side air holes 20 of the air cap 16 is adjusted in flow rate by means of a spread pattern adjustment device 23 and then ejected from the side air holes 20. In the spread pattern adjustment device 23, a pattern adjustment tab 24 is adapted to be rotated so that the compressed air is adjusted in flow rate. As a result thereof, the spray pattern of the coating material ejected from the coating material nozzle 30 is adjusted in spread angle in a fan shape.

Figure 6A:
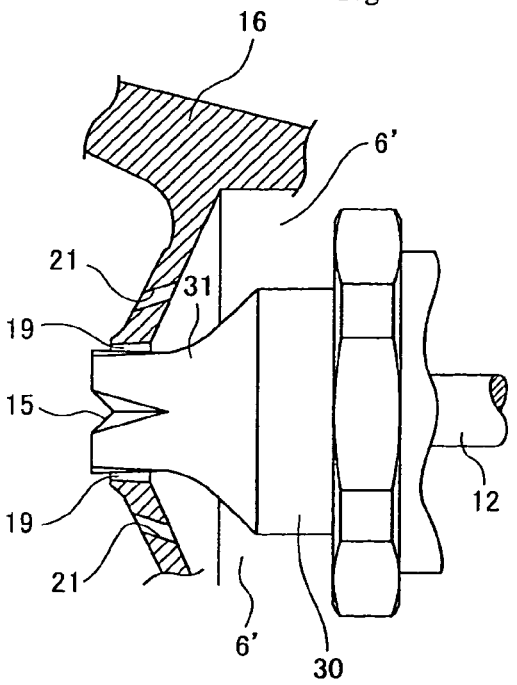
FIG. 6A is a side view of the air cap (shown in cross section) with the coating material nozzle together.
Figure 6B:
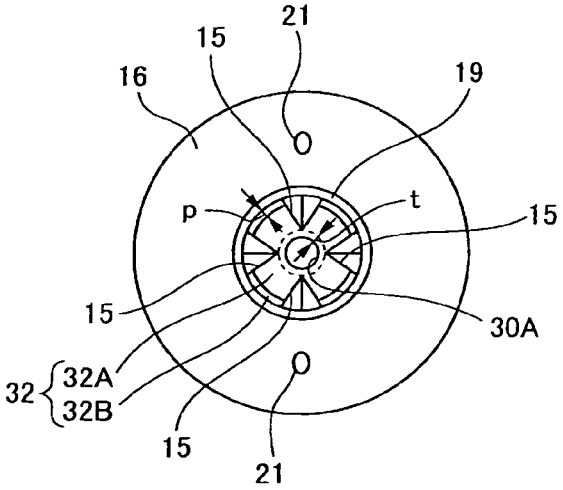
FIG. 6B is a front view of the same.

As shown in FIGS. 6A and 6B, though omitted in FIGS. 1, 3, and 4, the air cap 16 is formed in the vicinity of the nozzle tip end portion 31 of the coating material nozzle 30 with a pair of auxiliary air guide holes 21 having the nozzle tip end portion 31 of the coating material nozzle 30 in between. FIG. 6A is a side view of the air cap 16 (shown in cross section) with the coating material nozzle 30 together, and FIG. 6B is a front view of the same. The auxiliary air guide holes 21 are formed in communication with the air passage 6', and the air flow from the auxiliary air holes 21 intersects with the coating material flow from the coating material ejection opening 30A of the coating material nozzle 30. The auxiliary air holes 21 are adapted to take a balance with a force of the air flow ejected from the side air holes 20 for the purpose of spray pattern formation.

According to the spray gun 1 configured as described above, it becomes possible to have the following effects.

(1) In the spray gun 1, each air groove 15 of the coating material nozzle 30 is configured to have the bottom portion b thereof within the range of the guide wall 32A at an open end thereof. As a result thereof, it becomes possible to avoid the air flow in the air groove 15 from directly flowing in the coating material flow ejected from the coating material ejection opening 30A. Accordingly, it becomes possible to greatly reduce the resistance against the coating material flow generated by the air flow in the air grooves 15 penetrating in the coating material flow ejected from the coating material ejection opening 30A. Thus, it becomes possible to ensure a sufficient amount of the coating material flow ejected from the coating material ejection opening 30A of the coating material nozzle 30, and to increase the amount of the coating material flow in accordance with enlargement of the coating material ejection opening 30A in inner diameter.

(2) The spray gun 1 is configured so that the outer peripheral edge of the guide wall 32A is formed within the radial distance p of 0.5 mm or less from the outer peripheral edge of the nozzle tip end portion 31 of the coating material nozzle 30. As a result thereof, it is possible to have an effect of increase of the ejection amount of the coating material flow and improvement in atomization. It has been observed that, if the outer peripheral edge of the guide wall 32A is formed at the radial distance p of more than 0.5 mm from the outer peripheral edge of the nozzle tip end portion 31 of the coating material nozzle 30, a turbulent flow emerges on the tip end surface 32 of the coating material nozzle 30 due to the air flow in the air grooves 15 and another air flow on the outer peripheral surface of the nozzle tip end portion 31 of the coating material nozzle 30. On the other hand, if the radial distance p between the outer peripheral edge of the guide wall 32A and the outer peripheral edge of the nozzle tip end portion 31 of the coating material nozzle 30 is configured to be 0.5 mm or less, the turbulent flow will be diminished. As a result thereof, since the air flow along the guide wall 32A becomes smooth, it becomes possible to increase the ejection amount of the coating material and to improve the atomization of the coating material.

Figure 7A:
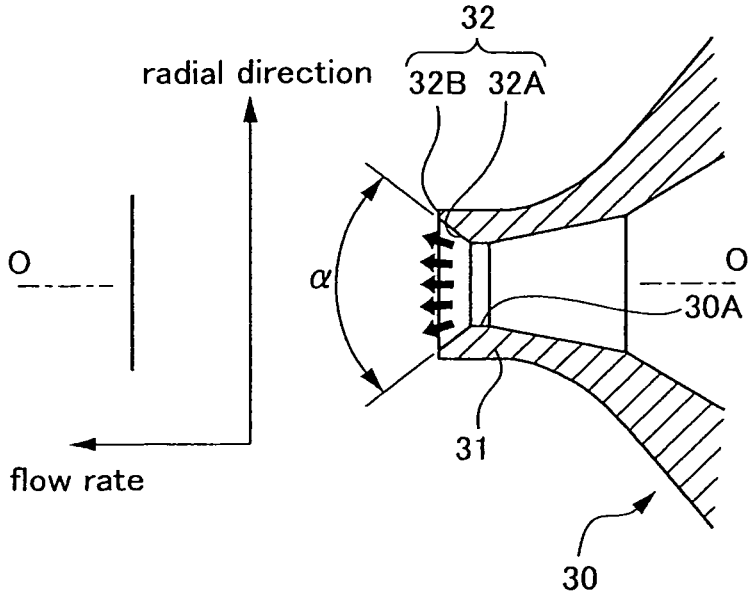
FIG. 7A shows a case in which the guide wall is formed to have an opening angle $\alpha$ between 60 and 150 degrees.

(3) In the spray gun 1, the guide wall 32A on the tip end surface 32 of the coating material nozzle 30 is configured to have the opening angle $\alpha$ between 60 and 150 degrees. As a result thereof, since the surface angular change to the guide wall 32A from the straight passage of the coating material ejection opening 30A of the coating material nozzle 30 can be reduced, the coating material flow along the guide wall 32A becomes as shown by arrows in the right part of FIG. 7A, thereby a smooth flow can be formed. As shown in the left part of FIG. 7A, the coating material flow toward the guide wall 32A becomes uniform, and the coating material is uniformly ejected from the coating material ejection opening 30A. As a result thereof, it is possible to have an effect of increasing the ejection amount of the coating material. Here, in the left part of FIG. 7A, the vertical axis corresponds to a radial direction of the tip end surface 32 of the coating material nozzle 30, and the horizontal axis corresponds to a flow rate of the coating material.

Figure 7B:
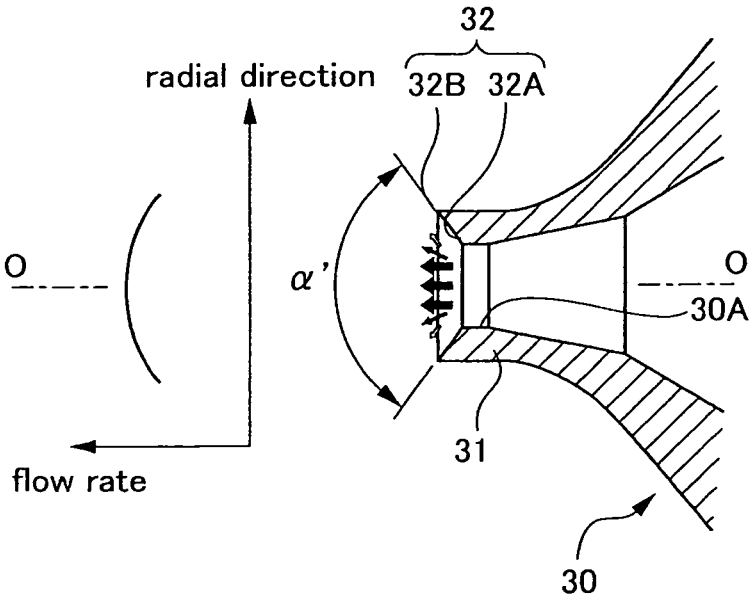
FIG. 7B shows a case in which the guide wall is formed to have an opening angle $\alpha'$ larger than 150 degrees.

On the other hand, FIG. 7B shows a distribution of ejection amount of the coating material from the coating material ejection opening 30A in a case in which the guide wall 32A is formed to have an opening angle $\alpha'$ larger than 150 degrees. As shown in the right part of FIG. 7B, the coating material ejected from the coating material ejection opening 30A does not flow well along the guide wall 32A. Therefore, as shown in the left part of FIG. 7B, the coating material flow is dense in the vicinity of a central axis of the coating material ejection opening 30A but becomes sparser toward off-center positions, thereby the uniformity of the coating material flow is broken.

(4) Thus, according to the spray gun 1 according to the present invention, it becomes possible to prevent hindrance to an increase in ejection amount of the coating material from the air flow that penetrates in the coating material ejected from the coating material ejection opening 30A through the plurality of air grooves 15 formed on the outer peripheral surface of the nozzle tip end portion 31 of the coating material nozzle 30. As a result thereof, it becomes possible to attain improvement in atomization and equalization of the coating material flow.

Second Embodiment

Figure 8A:
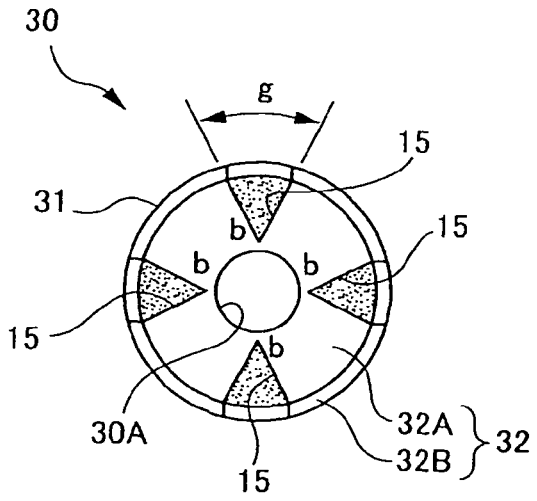
FIG. 8A is a front view of a tip end portion of a coating material nozzle.
Figure 8B:
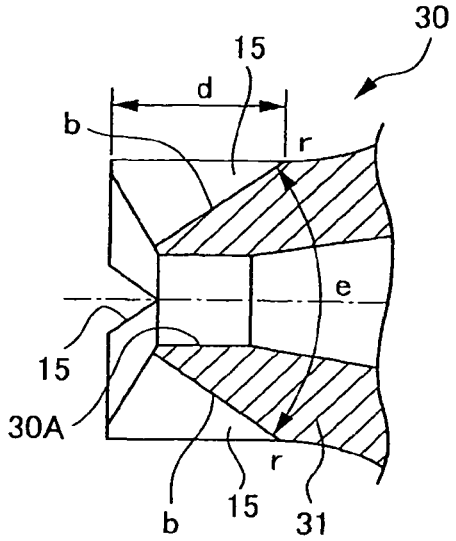
FIG. 8B is a cross sectional view thereof.

FIGS. 8A and 8B are configuration diagrams showing a principal part of a spray gun 1 according to a second embodiment of the present invention. FIG. 8A is a front view of a nozzle tip end portion 31 of a coating material nozzle 30, and FIG. 8B is a cross sectional view thereof.

Similarly as described in the first embodiment, the nozzle tip end portion 31 of the coating material nozzle 30 shown in FIGS. 8A and 8B includes on a tip end surface 32 a guide wall 32A spreading from an internal periphery of the coating material ejection opening 30A toward a tip end side of the coating material nozzle 30, and includes on an outer peripheral surface thereof a plurality of air grooves 15 channeled from a predetermined position on a rear end side thereof to the guide wall 32A in a longitudinal direction of the coating material nozzle 30. Each air groove 15 is configured to have a bottom portion b that gradually increases in depth toward the tip end side and opens to the tip end surface 32 of the coating material nozzle 30 within a range of the guide wall 32A.

In addition to the above described configuration, in the present embodiment, each air groove 15 is configured to have an opening angle g between 20 and 100 degrees and a length d (hereinafter, simply referred to as a "length d of the air groove") between 1.0 mm and 3.5 mm along a central axis of the coating material nozzle 30 from a foremost tip end surface of the coating material nozzle 30 to a starting point r of the air groove 15, and the bottom portions b of a pair of air grooves 15 facing toward each other are configured to have a convergence angle e between 30 and 100 degrees in side view toward the tip end surface 32.

The above described configuration is based on the following reason. The air flow in the air groove 15, when entering the coating material flow, becomes resistance thereto and reduces ejection amount of the coating material. If the resistance to the coating material increases, the reduction in ejection amount of the coating material will increase. If the resistance to the coating material decreases, the reduction in ejection amount of the coating material will decrease. Basically, the ejection amount of the coating material tends to decrease due to the presence of the air grooves 15.

On the other hand, the air flow in the air grooves 15 mixes with the coating material flow, i.e., the air grooves 15 increase chance of gas-liquid contact, enhance mixing efficiency, and improve atomization. Thus, atomization is improved due to the presence of the air grooves 15.

It is possible to adjust the resistance to the coating material flow and the mixing efficiency of the compressed air and the coating material by adjusting a passage area (area partitioned by an intersection contour of the air groove 15 with the guide wall 32A, i.e., area shown by dots in FIG. 8A) of the air grooves 15 on the guide wall 32A. If the resistance to the coating material flow increases, the mixing efficiency will increase.

The above described resistance and mixing efficiency can be controlled by way of the starting point r of each air groove 15, the convergence angle e of the facing pair of air grooves 15 toward the tip end side, and the opening angle g of each air groove 15. Since these parameters decide the passage area of the air groove 15, it can be said that the mixing efficiency depends on the passage area.

If the length d of the air groove 15 is less than 1.0 mm, the passage area of the air groove 15 will be too small to have the above described effect. If the length d of the air groove 15 exceeds 3.5 mm, the air groove 15 will open to inside of the coating material ejection opening 30A. Also, if the opening angle g of the air groove 15 is less than 20 degrees, the passage area of the air groove 15 will be too small to have the above described effect. If the opening angle g of the air groove 15 exceeds 100 degrees, the passage area of the air groove 15 will be too large to let out the coating material. Furthermore, if the convergence angle e of the air groove 15 is less than 30 degrees, the passage area of the air groove 15 will be too small to have the above described effect. If the convergence angle e of the air groove 15 exceeds 100 degrees, the air groove 15 will open to inside of the coating material ejection opening 30A.

It is needless to say that the configuration shown in the second embodiment can be employed in combination with any one of the above described first embodiment and the third to fifth embodiments, which will be described later.

Third Embodiment

Figure 9:
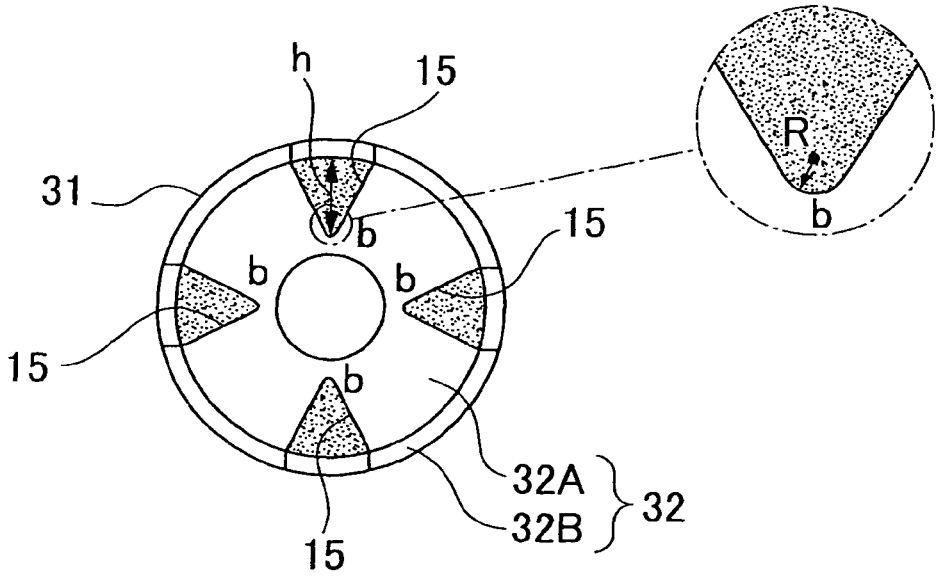
FIG. 9 is a front view of a tip end portion of a coating material nozzle showing a configuration of a principal part of a spray gun according to a third embodiment of the present invention.

FIG. 9 is a configuration diagram of a principal part of a spray gun 1 according to a third embodiment of the present invention. FIG. 9, corresponding to FIG. 8A, is a front view of a nozzle tip end portion 31 of a coating material nozzle 30.

Similarly as described in the first embodiment, the coating material nozzle 30 includes on a tip end surface 32 of the nozzle tip end portion 31 a guide wall 32A spreading from an inner periphery of a coating material ejection opening 30A toward a tip end side of the coating material nozzle 30, and includes on an outer peripheral surface thereof a plurality of air grooves 15 channeled from a predetermined position on a rear end side thereof to the guide wall 32A in a longitudinal direction of the coating material nozzle 30. Each air groove 15 is configured to have a bottom portion b that gradually increases in depth toward the tip end side and opens to the tip end surface 32 of the coating material nozzle 30 within a range of the guide wall 32A.

In addition to the above described configuration, in the present embodiment, the bottom portion b of each air groove 15 is configured to have a curvature radius R of 0.15 mm or less.

The above described configuration is based on the following reason. The air groove 15 of the nozzle tip end portion 31 of the coating material nozzle 30 is formed by, for example, a cutting tool, which has a nose R (nose radius) on a tip thereof. As a result thereof, the bottom portion b of the air groove 15 is also formed with the curvature radius R. Here, a passage area (shown by dots in FIG. 9) of the air groove 15 depends on the curvature radius R of the bottom portion b of the air groove 15. As the curvature radius R is smaller, a length h within the passage area of a line that extends passing through the bottom portion b and a center of the coating material ejection opening 30A becomes larger, the collision time of the coating material flow and the air flow becomes longer, and the mixture efficiency of the air flow with the coating material flow is more improved. Furthermore, in this case, mixture of the air flow to the coating material flow proceeds more gradually, and dispersion of the coating material flow proceeds more gradually as well, thus the coating material flow from the coating material nozzle 30 becomes less adhering to the air cap 16 disposed in proximity of the coating material nozzle.

Therefore, according to the spray gun 1 shown in the third embodiment, it becomes possible to improve the mixture efficiency of the air flow with the coating material flow and to avoid the adherence to the air cap 16 of the coating material from the coating material nozzle 30.

It is needless to say that the configuration shown in the third embodiment can be employed in combination with any one of the above described first and second embodiments and the fourth and fifth embodiments, which will be described later.

As above, in the third embodiment, a curvature radius R formed at a bottom portion of an air groove that is formed on a tip end portion of a coating material nozzle is configured to be 0.15 mm or less and not to exceed 0.15 mm.

According to the above described configuration, a passage area partitioned by an intersection contour of the air groove with a guide wall becomes large, a length corresponding to a height of the triangle shaped passage area becomes long, and a collision time of an air flow and a coating material flow becomes long. Thus, it becomes possible to enhance mixture efficiency of the air flow with the coating material flow. Furthermore, in this case, since the air flow mixes with the coating material flow slowly, and the coating material diffuses slowly, it becomes possible to avoid a drawback of the coating material flow from the coating material nozzle adhering to an air cap disposed in proximity to the coating material nozzle.

Fourth Embodiment

Figure 10:
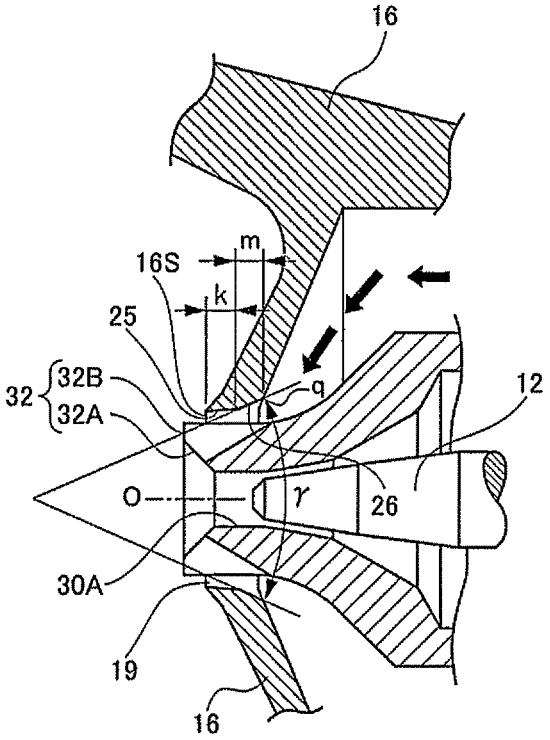
FIG. 10 is a cross sectional view of a tip end portion of a coating material nozzle and an air cap disposed surrounding the tip end portion showing a configuration of a principal part of a spray gun according to a fourth embodiment of the present invention.

FIG. 10 is a configuration diagram showing a principal part of a spray gun (body) 1 according to a fourth embodiment. FIG. 10 is a cross sectional view of a nozzle tip end portion 31 of a coating material nozzle 30 and an air cap 16 disposed surrounding the nozzle tip end portion 31.

Similarly as described in the first embodiment, the coating material nozzle 30 includes on a tip end surface 32 of the nozzle tip end portion 31 a guide wall 32A spreading from an internal periphery of a coating material ejection opening 30A toward a tip end side of the coating material nozzle 30, and includes on an outer peripheral surface thereof a plurality of air grooves 15 channeled from a predetermined position on a rear end side thereof to the guide wall 32A in a longitudinal direction of the coating material nozzle 30. Each air groove 15 is configured to have a bottom portion b that increases in depth toward the tip end side and opens to the tip end surface 32 of the coating material nozzle 30 within a range of the guide wall 32A.

In addition to the above described configuration, in the present embodiment, the air cap 16 includes on an inner peripheral surface thereof a parallel surface 25 that parallels and faces an outer peripheral surface of the nozzle tip end portion 31 of the coating material nozzle 30, and a tapered surface 26 that spreads in conical shape from a rear end of the parallel surface 25. The parallel surface 25 has, in side view, a width k between 0.3 mm and 1.0 mm along a central axis of the air cap 16. The tapered surface 26 has, in side view, a width m between 0.1 mm and 0.5 mm along the central axis of the air cap 16 and an opening angle γ between 10 and 90 degrees toward the rear end side of the coating material nozzle 30.

The above described configuration is based on the following reason. If an air flow entering the air grooves 15 is sufficiently strong, the air flow in the air grooves 15 will be smooth, and efficiency will be enhanced of collision and mixture of the air flow with a coating material flow. As a result thereof, the coating material flow will be well dispersed and equalized.

The air flow entering the air grooves 15 becomes stronger as a starting point r of the air groove 15 is positioned more on a side of the body than a rear end q of a slit 19 in a ring shape formed between the air cap 16 and the nozzle tip end portion 31 of the coating material nozzle 30. This is because the air flow coming in the air cap 16 directly heads toward the air grooves 15, thereby the air flow in the air grooves 15 becomes strong.

If the starting point r of the air groove 15 is set more forward than the rear end q of the slit 19, the air flow will not directly enter the air grooves 15. Therefore, the air flow in the air grooves 15 will be weak, and efficiency of mixture with the coating material will decrease.

As described above, the inner peripheral surface of the air cap 16 is formed with the parallel surface 25 facing parallel to the outer peripheral surface of the nozzle tip end portion 31 of the coating material nozzle 30, as well as the tapered surface 26 spreading in conical shape from the rear end of the parallel surface 25. The parallel surface 25 is adapted to maintain straight the air flow in a gap with the coating material nozzle 30, thereby ensure ejection amount of the coating material. The tapered surface 26 is adapted to smooth the air flow to the parallel surface 25 and to adjust the strength of the air flow entering the air grooves 15 by adjusting the width m of the tapered surface 26.

If the width k of the parallel surface 25 along the central axis of the air cap 16 is less than 0.3 mm, the air flow cannot be maintained straight, and the ejection amount of the coating material will decrease. On the other hand, if the width k of the parallel surface 25 along the central axis of the air cap 16 exceeds 1.0 mm, the parallel surface 25 of the air cap 16 will be close to the starting point r, and a passage area of the air flow will be narrow. Therefore, amount of the air flow in the air grooves 15 is restricted, which causes decrease in atomization and ejection amount of the coating material. Therefore, the width k of the parallel surface 25 along the central axis of the air cap 16 is preferably set in the range of 0.3 mm to 1.0 mm.

With regard to the tapered surface 26, as the width m thereof along the central axis of the air cap 16 is shorter, the air flow entering the air grooves 15 becomes stronger, which will cause the coating material to disperse better and to be more uniform to form a more flat spray pattern. However, if the width m is less than 0.1 mm, the air flow entering the air grooves 15 will be excessively strong, and the ejection amount of the coating material will decrease. On the other hand, if the width m of the tapered surface 26 along the central axis of the air cap 16 exceeds 0.5 mm, the air flow entering the air grooves 15 will be weak, and the coating material flow will be dense in a center portion thereof, which is called "center thick". Therefore, the width m of the tapered surface 26 along the central axis of the air cap 16 is preferably set in the range of 0.1 mm to 0.5 mm.

Although the tapered surface 26 shown in FIG. 10 is a single tapered surface, there is no limitation thereto, and a multi tapered surface may be employed as the tapered surface 26, thereby the air flow will be smoother, and the spray pattern of the coating material flow can be stabilized to be flat. Furthermore, the tapered surface 26 may be configured to have a curved surface along the central axis of the air cap 16, which will have a similar effect of smoothing the air flow.

It is needless to say that the configuration shown in the fourth embodiment can be employed in combination with any one of the above described first to third embodiments and the fifth embodiment, which will be described later.

Fifth Embodiment

Figure 11:
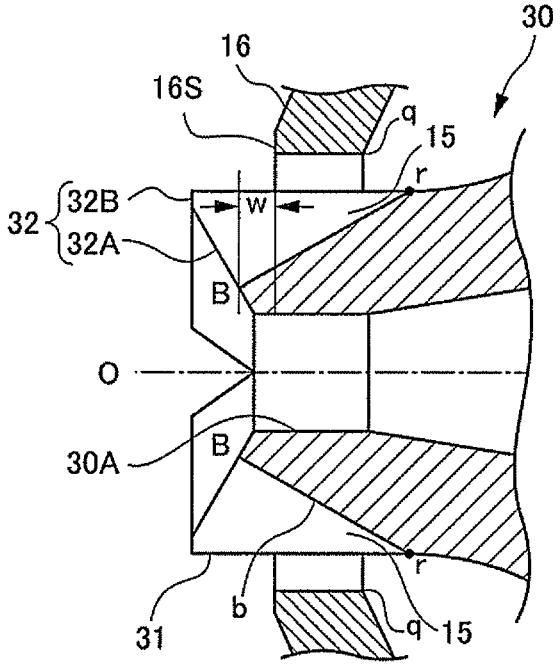
FIG. 11 is a cross sectional view of a tip end portion of a coating material nozzle along with an air cap showing a configuration of a principal part of a spray gun according to a fifth embodiment of the present invention.

FIG. 11 is a configuration diagram of a principal part of a spray gun 1 according to a fifth embodiment. FIG. 11 is a cross sectional view of a nozzle tip end portion 31 of a coating material nozzle 30 along with an air cap 16.

The coating material nozzle 30 and the air cap 16 are configured similarly to, for example, the configuration shown in the first embodiment.

Here, a distance W is defined between a front end surface 16S proximate to the coating material nozzle 30 of the air cap 16 and a bottom (denoted by B in FIG. 11) of an open end of an air groove 15 on a guide wall 32A of the coating material nozzle 30. The bottom B is configured to be positioned between 0.5 mm ahead and 0.5 mm behind in relation to the front end surface 16S along a longitudinal direction of the nozzle tip end portion 31.

In the example of FIG. 11, the bottom B of the open end of the air groove 15 on the guide wall 32A of the coating material nozzle 30 is positioned 0.5 mm ahead of the front end surface 16S of the air cap 16.

According to the spray gun 1 thus configured, it becomes possible to avoid adherence of coating material to the air cap 16 as well as to improve dispersion and atomization of the coating material. If the coating material nozzle 30 is configured to have the bottom B of the open end of the air groove 15 on the guide wall 32A positioned backward along the longitudinal direction of the nozzle tip end portion 31 of the coating material nozzle 30 in relation to the front end surface 16S proximate to the coating material nozzle 30 of the air cap 16, an air flow flowing in a coating material flow will increase, and the dispersion and atomization of the coating material will be improved.

However, in this case, since the coating material flow and the air flow are mixed in the vicinity of the air cap 16, it is difficult to avoid the air cap 16 from adherence of the coating material diffused from the coating material nozzle 30. Therefore, if the coating material nozzle 30 is configured to have the bottom B of the open end of the air groove 15 on the guide wall 32A positioned forward in relation to the front end surface 16S of the air cap 16 along the longitudinal direction of the nozzle tip end portion 31 of the coating material nozzle 30, it will be possible to avoid the adherence to the air cap 16 of the coating material diffused from the coating material nozzle 30.

In view of the above described trade-off, in the present embodiment, it is configured so that the bottom B of the open end of the air groove 15 on the guide wall 32A is positioned between 0.5 mm ahead and 0.5 mm behind in relation to the front end surface 16S of the air cap 16 along the longitudinal direction of the nozzle tip end portion 31 of the coating material nozzle 30, thereby it becomes possible to avoid the adherence to the air cap 16 of the coating material as well as to improve the dispersion and atomization of the coating material.

It is needless to say that the configuration shown in the fifth embodiment can be employed in combination with any one of the above described first to fourth embodiments.

It should be noted that the present invention is not limited to the scope described in the embodiments described above. It will be clear to those skilled in the art that modifications and improvements may be made to the embodiments described above. It should be noted that such modifications and improvements are included in the scope of the present invention.

REFERENCE SINGS LIST

1 spray gun (body)
2 gun barrel
3 trigger
3A fulcrum
4 grip part
5 air nipple
6, 6' air passage
7 air valve part
8 valve stem
9 air valve
10 guide chamber
11 needle valve guide
12 needle valve
13 coil spring
14 coating material joint
15 air groove
16 air cap
16A horn portion
16S tip end surface (of the air cap)
18 air cap cover
19 slit (in a ring shape)
20 side air hole
21 auxiliary air hole
23 spread pattern adjustment device
24 pattern adjustment tab
25 parallel surface
26 tapered surface
30 coating material nozzle
30A coating material ejection opening
31 nozzle tip end portion
32 tip end surface (of the coating material nozzle)
32A guide wall
32B flat portion

CITATION LIST

Patent Literature

Patent Literature 1: Japanese Unexamined Patent Application Publication No. 8-196950
Patent Literature 2: WO01/02099

The invention claimed is:

1. A spray gun for mixing and atomizing a coating material flow and the air flow in the atmosphere, the spray gun comprising:

a body having a gun barrel;

a coating material nozzle disposed on a tip end side of the gun barrel, the coating material nozzle including a coating material ejection opening formed on a tip end surface of the coating material nozzle, the coating material ejection opening being configured to eject the coating material flow;

an air cap disposed on the tip end side of the gun barrel to surround a tip end portion of the coating material nozzle, the air cap defining a ring-shaped slit between an inner peripheral surface of the air cap and an outer peripheral surface of the tip end portion of the coating material nozzle to allow the air flow to be ejected therethrough, wherein the tip end portion of the coating material nozzle includes:

a guide wall formed on the tip end surface of the coating material nozzle, the guide wall having a conical shape and spreading from an internal periphery of the coating material ejection opening toward a tip end side of the coating material nozzle, the guide wall controlling the coating material flow ejected from the coating material ejection opening;

a plurality of air grooves formed on the outer peripheral surface of the tip end portion of the coating material nozzle, the air grooves having a V-shaped cross-section when viewed in a direction perpendicular to a longitudinal direction, the air grooves being channeled in the longitudinal direction from a predetermined position on a rear end side of the outer peripheral surface of the tip end portion to the guide wall, the air grooves inducing a part of the air flow ahead of the coating material ejection opening; and, each of the air grooves has a bottom portion gradually increasing in depth in the longitudinal direction, the bottom portion being located on a circle larger in diameter than the internal periphery of the coating material ejection opening on the guide wall, the bottom portion having a curvature radius R of 0.15 mm or less.

2. The spray gun according to claim 1, wherein the guide wall has an outer peripheral edge located inwardly from an outer periphery of the tip end portion of the coating material nozzle in the range not exceeding 0.5 mm in front view.

3. The spray gun according to claim 1, wherein the guide wall has an opening angle in the range of 60 degrees to 150 degrees in side view.

4. The spray gun according to claim 1, wherein at least one of the air grooves is formed with the bottom portion having a convergence angle directing toward the tip end side of the coating material nozzle in the range of 30 degrees to 100 degrees.

5. The spray gun according to claim 1, wherein at least one of the air grooves has a length in the longitudinal direction of the coating material nozzle from the rear end side thereof in the predetermined position to the foremost of the tip end surface of the coating material nozzle in the range of 1 mm to 3.5 mm.

6. The spray gun according to claim 1, wherein at least one of the air grooves has an opening angle of the V-shaped cross section in the range of 20 degrees to 100 degrees.

7. The spray gun according to claim 1, wherein the bottom portion of at least one of the air grooves is located on the guide wall of the coating material nozzle between at 0.5 mm ahead and at 0.5 mm behind, in relation to a front surface of the air cap proximate to the coating material nozzle, in the longitudinal direction of the tip end portion of the coating material nozzle.

* * * * *